US009190707B2

(12) United States Patent
Hedemaki et al.

(10) Patent No.: US 9,190,707 B2
(45) Date of Patent: Nov. 17, 2015

(54) METHOD FOR MANUFACTURING AN RF FILTER AND AN RF FILTER

(75) Inventors: Mika Hedemaki, Naples, FL (US); John Kevin Pryor, Naples, FL (US); William Baldwin Johnson, Naples, FL (US)

(73) Assignee: Prism Microwave, Inc., Coppell, TX (US)

( * ) Notice: Subject to any disclaimer, the term of this patent is extended or adjusted under 35 U.S.C. 154(b) by 730 days.

(21) Appl. No.: 13/294,590

(22) Filed: Nov. 11, 2011

(65) Prior Publication Data

US 2013/0093539 A1 Apr. 18, 2013

(30) Foreign Application Priority Data

Oct. 18, 2011 (FI) ..... 20116030

(51) Int. Cl.
*H01P 1/20* (2006.01)
*H01P 11/00* (2006.01)
*H01P 1/205* (2006.01)

(52) U.S. Cl.
CPC ..... *H01P 11/007* (2013.01); *H01P 1/2053* (2013.01); *Y10T 29/49016* (2015.01)

(58) Field of Classification Search
CPC ..... H01P 1/06; H01P 1/065; H01P 1/2053; H01P 1/12084; H01P 11/008
USPC ..... 333/203, 206, 22, 227, 212
See application file for complete search history.

(56) References Cited

U.S. PATENT DOCUMENTS

| | | | | |
|---|---|---|---|---|
| 3,757,204 | A * | 9/1973 | Hyde | 324/321 |
| 5,225,799 | A * | 7/1993 | West et al. | 333/202 |
| 5,843,871 | A * | 12/1998 | Beik et al. | 505/210 |
| 2003/0052571 | A1 | 3/2003 | Mikkonen | |
| 2010/0102902 | A1 * | 4/2010 | Jung | 333/212 |

FOREIGN PATENT DOCUMENTS

| | | |
|---|---|---|
| EP | 0823746 A2 | 2/1998 |
| EP | 1746681 A1 | 1/2007 |
| EP | 2323214 A1 | 5/2011 |

OTHER PUBLICATIONS

International Search Report for PCT/US2011/060360 dated Jun. 21, 2012.
International Preliminary Report on Patentability for International Application No. PCT/US2011/060360 issued Apr. 22, 2014.

* cited by examiner

*Primary Examiner* — Robert Pascal
*Assistant Examiner* — Kimberly Glenn
(74) *Attorney, Agent, or Firm* — Wolf, Greenfield & Sacks, P.C.

(57) ABSTRACT

The invention relates to a method for manufacturing an RF filter comprising several resonator cavities and an RF filter manufactured by the method. The resonator cavities are formed into shape from a copper plate in a first manufacturing phase. In a second manufacturing phase the formed resonator cavities are inserted or integrated into a chassis material of the RF filter.

17 Claims, 6 Drawing Sheets

METHOD FOR MANUFACTURING AN RF FILTER AND AN RF FILTER

TECHNICAL FIELD

The invention relates to a method for manufacturing coaxial RF filter assemblies. The invention also relates to a coaxial RF filter that is manufactured by the manufacturing method.

BACKGROUND OF THE INVENTION

Conventional coaxial RF filter apparatus generally discloses a metal-based chassis. Aluminium is commonly used as a chassis material due to its mechanical, thermal and electrical properties. The resonator cavities of the RF filter are formed in the base material, either by a cast or machining process. This type of an RF filter apparatus is used due to the good electrical characteristics combined with rigid mechanical construction. Metal-based chassis allows easy assembly of the other components. The metal chassis also provides for the components an electrical and heat conductor.

Electric losses in the cavities of the RF filter are due to electric currents flowing in cavity walls. To improve the electrical characteristics of the resonator the cavity can be plated by a metal having good conductivity. Some examples of possible metals are silver and copper. By plating with silver or copper, the electrical conductivity of the wall can be increased compared to the conductivity of aluminium and that way the electrical losses can be reduced. Silver or gold can be utilized as a plating material for preventing oxidation in cavity walls in certain applications.

A conventional RF filter chassis is typically machined from a metal block or formed into shape in a casting process. The metal block can be made of aluminium, for example. Copper or silver plating layer is then applied in a secondary operation. The metal-based filter chassis is heavy and the plating operation complicates the supply chain. Additionally, electroplating process involves hazardous chemicals in the metal cleaning process (typically the cleaning process includes solvent cleaning, hot alkaline detergent cleaning, electro cleaning or acid treatment) and in the plating bath which includes cyanides of the metal to be deposited as well as cyanides of other metals.

In a corrosive environment the outer metallic surface of the RF filter will require to be plating-free to avoid corrosion. Plating-free surface is typically created by selectively plating the housing, by powder coating the plating-free surfaces prior to the electroplating process. Outdoor use of the filter is considered to be a corrosive environment.

Publication US 2010/0102902 depicts a manufacturing method for an RF filter cavity. In the depicted manufacturing method an interior structure of the RF filter has been formed from a metal plate (aluminium) by deep drawing. The formed cavity structure is in the next step attached to a plastic housing. In the end the cavity structure is plated with silver.

Patent publication U.S. Pat. No. 4,706,051 depicts a waveguide filter having multiple resonant cavities. The waveguide filter comprises two similar parts that are manufactured by impact extrusion. After impact extrusion, each manufactured part includes a bottom wall, side walls, end walls, and separating walls. One manufactured part creates one half of the waveguide filter. Two manufactured parts are reverse-coupled for composing the waveguide filter.

SUMMARY OF THE INVENTION

An object of the present invention is to provide a method for manufacturing an RF cavity filter without any plating processes and a coaxial RF filter manufactured by the method.

The objects of the invention are achieved by a manufacturing method in which the conductive layer in the resonator cavities is created by a layer of conductive material that is formed into shape. The shape can be in a form of a single round cavity or a plurality of round cavities, for example. The cavity can advantageously be formed using a copper sheet by deep drawing or impact extrusion process. The formed resonator cavities may be inserted into the RF filter chassis or the RF filter chassis may be injection molded around the resonator cavities.

An advantage of the invention is that no plating of the cavity surface of the resonator is required as the cavity wall is formed out of a material having good electrical conductivity.

Another advantage of the invention is that the manufacturing process does not include any hazardous chemicals.

Another advantage of the invention is that a proper material for the main housing of the RF filter can be selected for each application. As an example, an outdoor application could be made by utilizing a plastic housing which is light weight and corrosion free.

Yet another advantage of the invention is that the conductive layer in the cavity wall is thick which decreases electrical losses in the cavity resonator.

The manufacturing method of an RF filter having cavity resonators is characterized in that in the manufacturing method the resonator cavities are formed into shape from a copper plate in a first manufacturing step and the formed resonator cavities are inserted or integrated into a chassis material in separate manufacturing steps.

The RF filter according to the invention comprising at least one resonator cavity, a chassis of the RF filter, a metallic bottom plate, a cover plate, an input connector, and an output connector is characterized in that the resonator cavities are formed into shape from a copper plate and that they are configured to be inserted or integrated into a chassis of the RF filter.

Some advantageous embodiments of the invention are presented in the dependent claims.

The basic idea of the invention is the following: One resonator cavity or uniform cavity pluralities may advantageously be formed from a copper sheet by deep drawing or impact extrusion process. Next, a plurality of resonator cavities or uniform cavity pluralities can be connected or integrated into an RF filter preform.

The resonator cavities of the RF filter preform are held in place by a chassis material of the RF filter. The chassis may advantageously be formed in a light weight material. Some examples of the light weight material are plastics and aluminium. In one advantageous embodiment the formed resonator cavities are inserted into a ready-made RF filter chassis either one by one or as one entity including several resonator cavities. The resonator cavities are advantageously fastened by some mechanical connecting means to a bottom plate that is fastened to the lower surface of the RF filter chassis.

Alternatively the chassis may be manufactured by injection molding plastic around the resonator cavities of the RF filter preform. The RF filter chassis material may be different in different applications. The chassis may be uniform or a skeleton in type. Because the RF filter chassis is not formed from a metal block, the weight of the RF filter assembly can be significantly decreased.

Grounding of the resonator cavity may advantageously, but not exclusively, be achieved by a compression contact between the resonator cavity top and the tuning cover. In the high power applications heat transfer from the cavity resonator may then advantageously be achieved through the cavity bottom to the metal base plate. The metal base plate may be individual for a single cavity resonator or a matrix for a plurality of resonators.

Further scope of applicability of the present invention will become apparent from the detailed description given hereafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and accompanying drawings which are given by way of illustration only, and thus are not limitative of the present invention and wherein.

DETAILED DESCRIPTION OF THE DRAWINGS

In the following description, considered embodiments are merely exemplary, and one skilled in the art may find other ways to implement the invention. Although the specification may refer to "an", "one"; or "some" embodiment(s) in several locations, this does not necessarily mean that each such reference is made to the same embodiment(s), or that the feature only applies to a single embodiment or all embodiments. A single feature of different embodiments may also be combined to provide other embodiments.

Figure 1A:
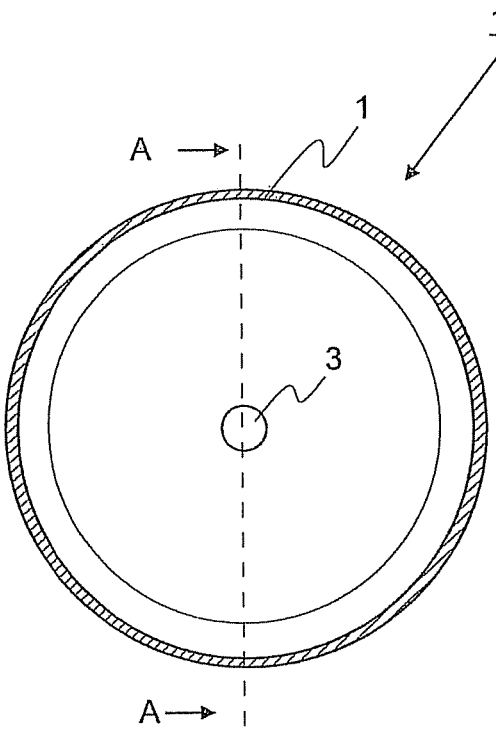
FIG. 1*a* shows as an example a schematical representation of a round resonator cavity preform seen from above.
Figure 1B:
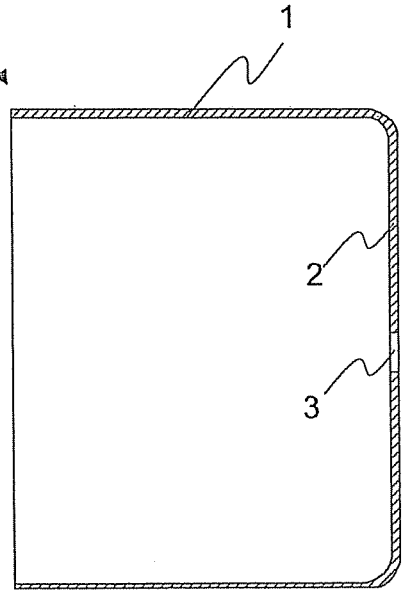
FIG. 1*b* shows a side projection A-A of the resonator cavity preform of FIG. 1*a;*

FIGS. 1*a* and 1*b* depict as an example a round resonator cavity preform 10 of an RF filter. The resonator cavity preform 10 has been achieved through deep drawing or impact extruding it from a proper copper plate. FIG. 1*a* depicts the resonator cavity preform 10 as seen from above and FIG. 1*b* shows a side projection A-A of the resonator cavity preform of FIG. 1*a*. The shape of the resonator cavity preform is substantially similar to an open barrel. As can be seen in FIGS. 2-5, in some embodiments there may be one or more resonator cavities, and each may be cylindrical. It has a round wall section 1, a substantially flat bottom section 2 and an opening 3 in the center of the bottom section 2. The resonator cavity preform 10 is defined by application's physical size constraints and the intended characteristics of the RF filter. The round copper wall section 1 is so thick that it is not necessary to plate the interior of the resonator cavity with some other electrically conductive material.

The invention is not limited to the round resonator cavity that is shown in FIGS. 1*a* and 1*b*. It is evident to a man skilled in the art that any other suitable geometrical shape that is usable as a resonator cavity may also be utilized. It is also evident to a man skilled in the art that several resonator cavities may be manufactured in one and the same machining operation.

A resonator element (not shown in FIG. 1*a* or 1*b*) may be fastened mechanically via the opening 3 in the bottom section 2 of the resonator cavity 10 by some mechanical connecting means, for example by a screw, to the metallic base plate of the RF filter. Heat transfer from the RF filter cavity to the base plate may advantageously be achieved through the same connection.

Figure 2:
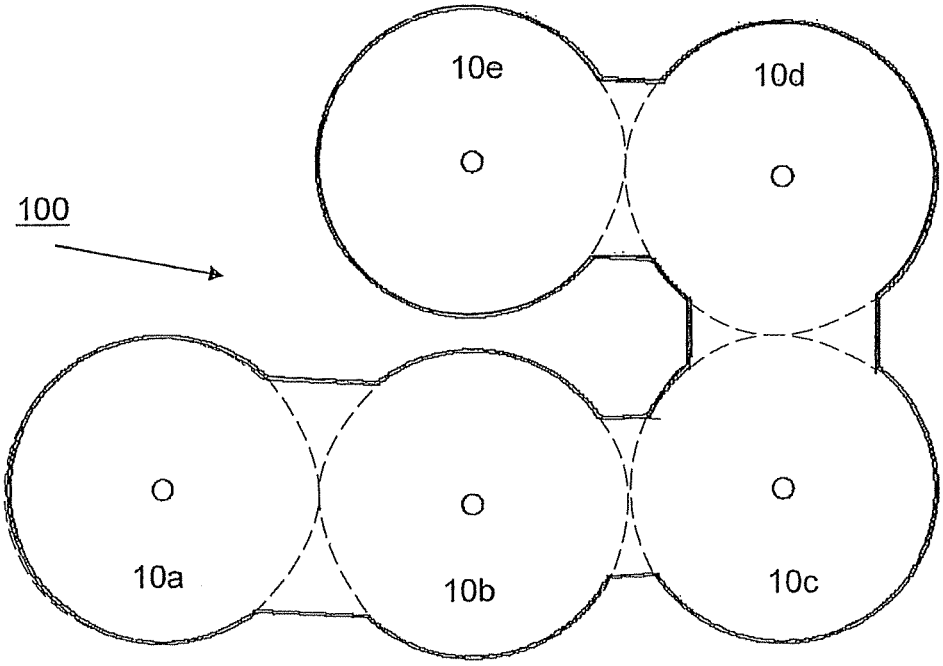
FIG. 2 shows an example of an RF filter preform according to the invention comprising resonator cavities fastened together seen from above.

In FIG. 2 is shown a top view of an exemplary RF filter preform 100 according to one embodiment of the invention that comprises five coaxial resonator preforms 10*a*-10*e* that have been connected mechanically to each other. Advantageously each of the individual coaxial cavity preforms has been manufactured from a copper plate by a proper manufacturing machine, for example by a deep drawing or an impact extrusion machine. In another advantageous embodiment several coaxial cavity preforms are manufactured as one entity.

The layout of the RF filter preform 100 is defined by the RF filter characteristics to be fulfilled. Each resonator cavity preform 10*a*-10*e* has been shaped in such a way that at least two coaxial resonator cavity preforms may be fastened mechanically to each other. For example side walls of the coaxial resonator cavity resonators 10*a* and 10*b* have been cut and bent in such a way that they can be connected mechanically to each other. After a mechanical joint there exists a free space between the fastened resonator cavity preforms 10*a* and 10*b*.

In a second advantageous embodiment a mechanical metallic contact between two adjacent resonator cavities is not necessary. In that embodiment, the resonator cavities are isolated from each other but they are connected by means of a low electrical loss path.

The other resonator cavity preforms 10*c*-10*e* have been formed respectively so that the defined mechanical layout of the RF filter preform shown in FIG. 2 is achieved.

Figure 3:
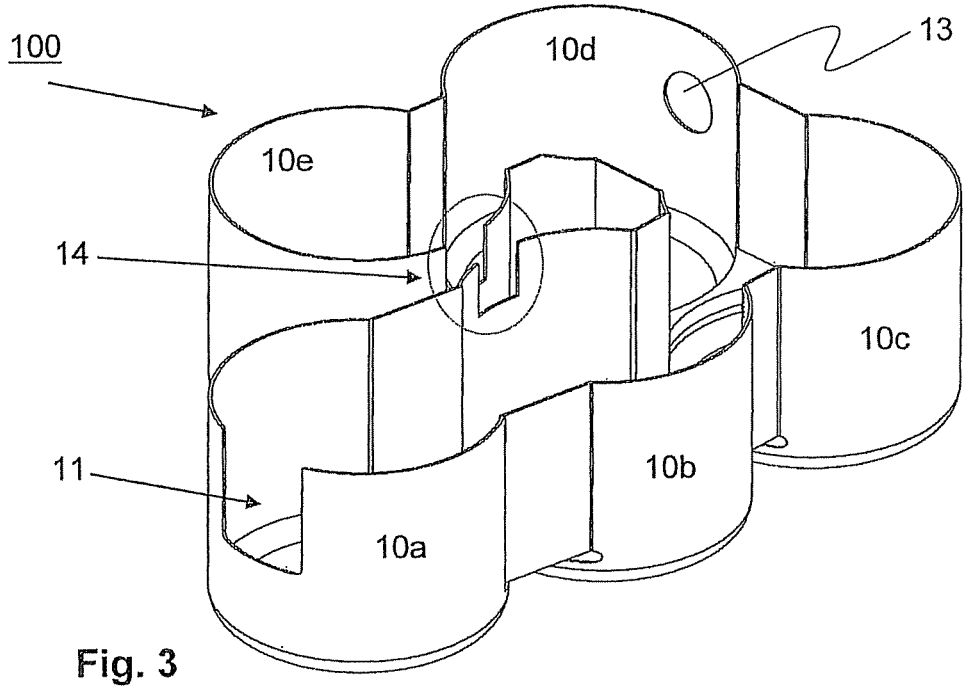
FIG. 3 shows the exemplary RF filter preform of FIG. 2 as a perspective view.

In FIG. 3 is shown the exemplary RF filter preform 100 of FIG. 2 in a perspective view. In the depicted example an aperture 11 to which electrical output connection means may be assembled has been made to the resonator cavity preform 10*a*. A round opening 13 has been made to the resonator cavity preform 10*d* to which opening electrical input connection means may be assembled. The embodiment of FIG. 2 comprises also a partial slot opening for a cross coupling element between the resonator cavity preforms 10*b* and 10*e*. The exemplary cross coupling connection may advantageously be achieved through openings made in the walls of the resonator cavity preforms 10*b* and 10*e*. The partial free space connection is depicted in FIG. 3 by a dotted circle, reference 14.

Figure 4:
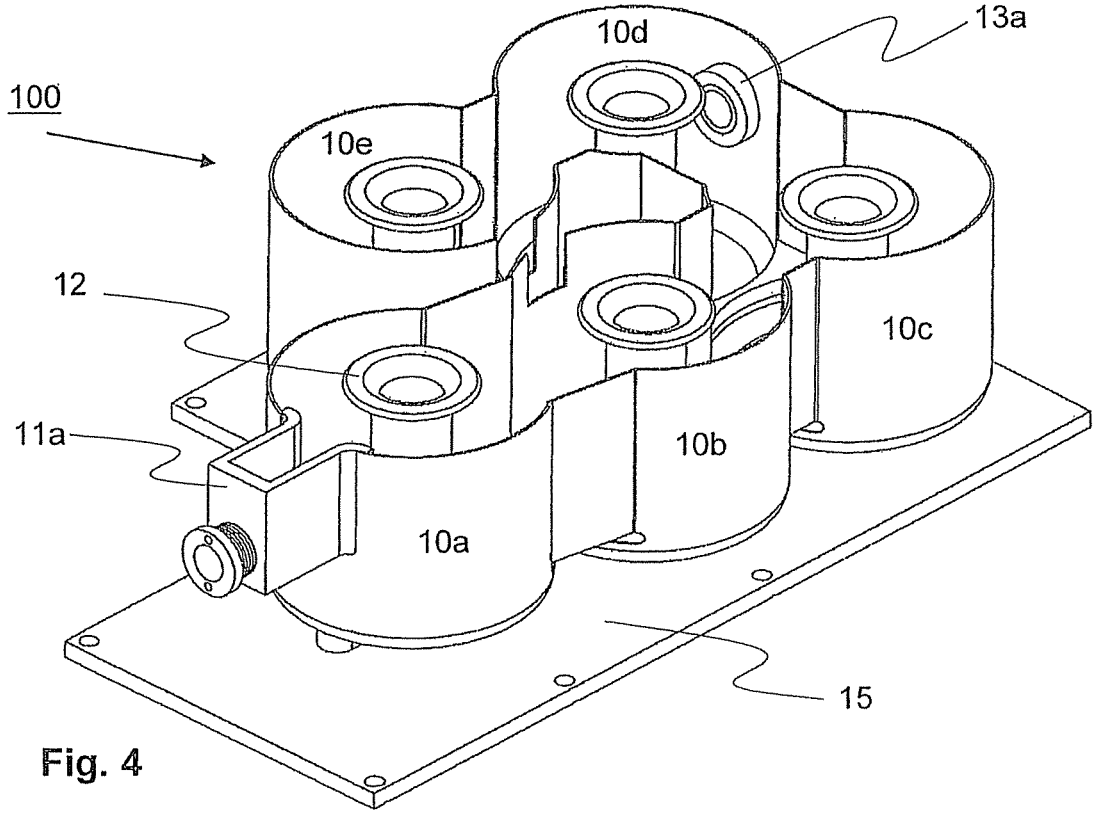
FIG. 4 shows the exemplary RF filter preform of FIG. 3 when a base plate and input and output means are assembled to the RF filter entity.

In FIG. 4 is shown in a perspective view when the exemplary RF filter preform 100 has been assembled on a metallic base plate 15. The bottom sections 2 of the resonator cavities 10*a*-10*e* of the RF filter preform 100 have advantageously been fastened to the metallic base plate 15 by mounting the resonator elements through the openings 3 in the cavity preforms 10*a*-10*e* to the metallic base plate 15. For example a screw or a bolted joint may be utilized. The resonator cavity preform is compressed in between this contact.

In the example of FIG. 4 are also depicted output means 11*a* that are assembled to the opening 11 in the wall section 2 of the resonator cavity preform 10*a*. Correspondingly into the round opening 13 has been assembled input means 13*a*. The depicted coaxial connections in the filter assembly are only examples. The input and/or output means can be realized also by the use of metal bushing or metal trough making electrical contact to inner and outer conductor in each end of the assembly.

Reference 12 depicts a resonator in the resonator cavity 10*a*. Correspondingly also other resonator cavities 10*b*-10*e* include their own resonator.

Figure 5:
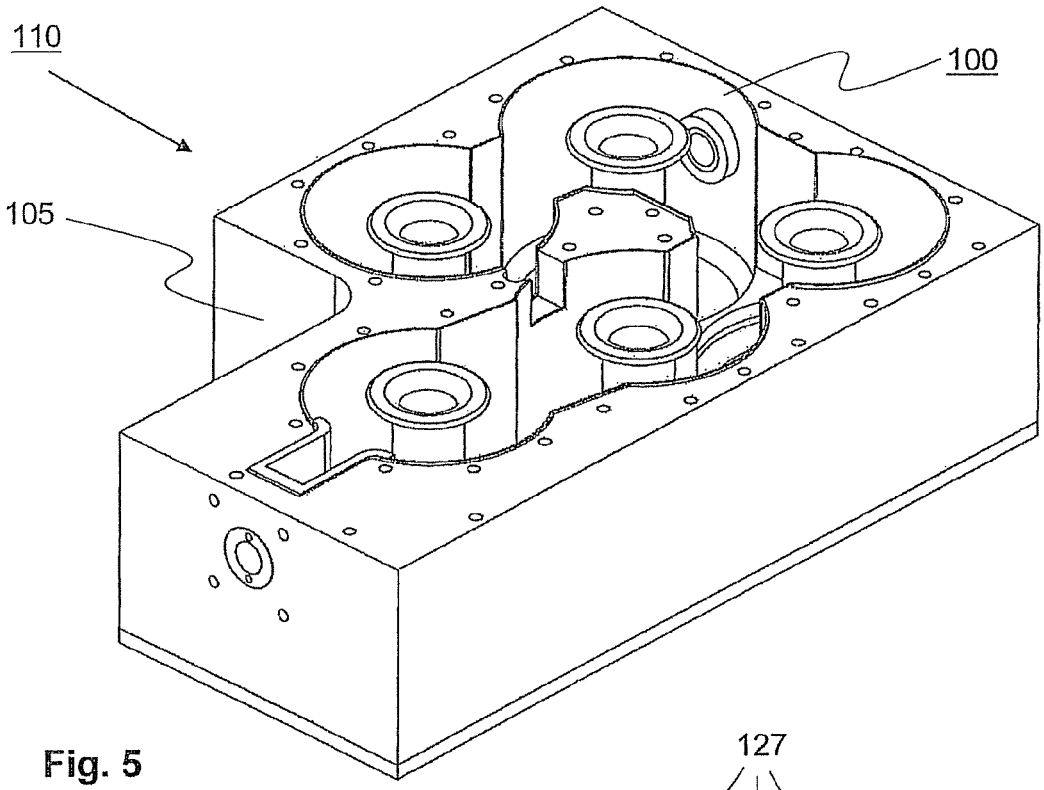
FIG. 5 shows the exemplary RF filter preform of FIG. 4 when the RF filter preform is inserted into the chassis material of the RF filter.

In FIG. 5 is shown in a perspective view when the exemplary RF filter preform 100 has been inserted into the RF filter chassis material 105. The RF filter chassis 105 may be made for example by injection moulding proper plastic material around the RF filter preform 100.

Alternatively the chassis 105 may first be made by moulding it from plastic or metal, for example from aluminium. When the chassis 105 is finished, the resonator cavity preforms 10 or the RF filter preform 100 are/is in a second step inserted into the manufactured chassis 105. In that embodiment the wall sections 1 of the RF filter preform 100 remain a little above the top surface of the chassis 105 when the RF filter preform has been inserted into the chassis.

The reference sign 110 depicts the RF filter when the resonator cavity preforms 10 or the RF filter preform 100 are/is installed in their/its place into the chassis 105.

The chassis material is advantageously selected on grounds of the requirements of the use site. In outside applications the chassis material may be proper plastic for preventing corrosion on the outer surface of the RF filter. On the other hand, if heat transfer from the RF filter is required, the chassis may at least partly be made from metal, for example from aluminium.

Figure 6:
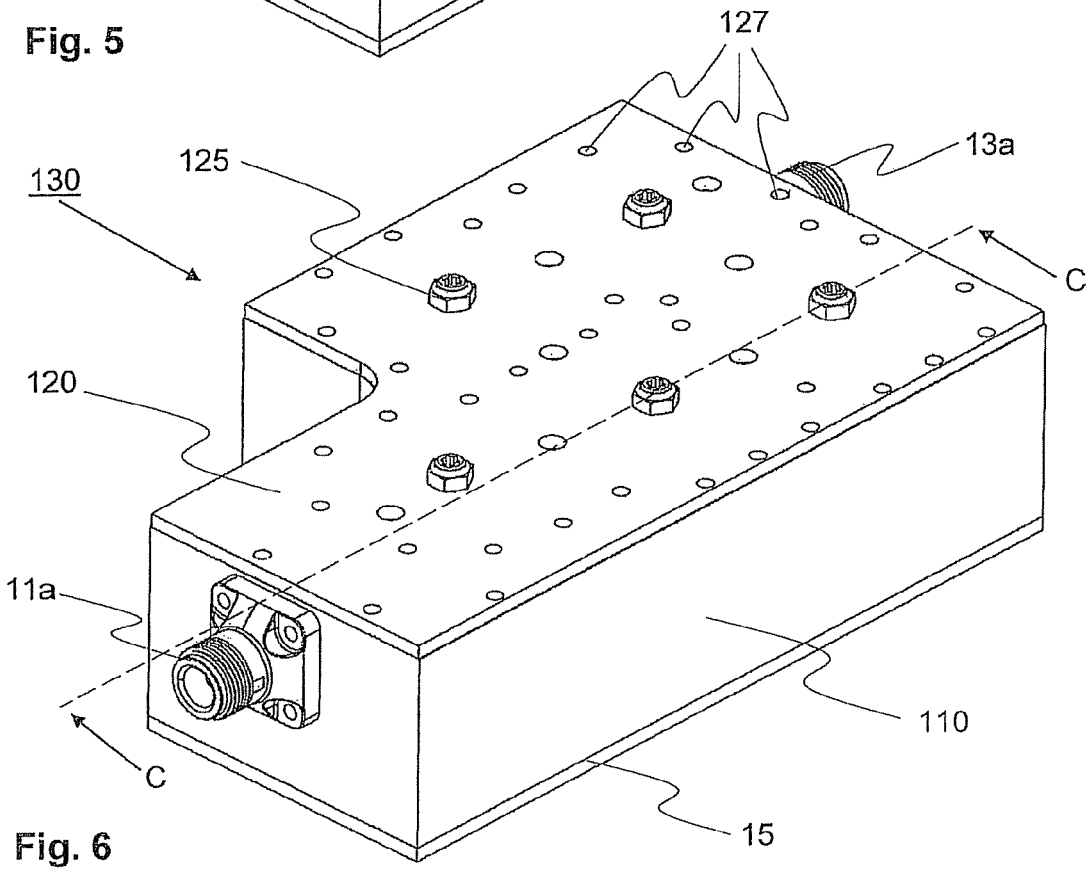
FIG. 6 shows the exemplary RF filter of FIG. 5 when the cover plate of the RF filter has been installed.

In FIG. 6 is shown a perspective view of a cover plate 120 which has been fastened to the RF filter preform 110. References 127 depict bolt holes by which the cover plate 120 may be fastened to the chassis 105 of the RF filter 130.

Reference 125 depicts an end of one tuning screw in one resonator cavity. The output connector 11*a* and input connector 13*a* are also shown. When the cover plate 120, output connector 11*a*, and input connector 13*a* are fastened, the RF filter assembly 130 is complete.

In an embodiment where the chassis 105 has been manufactured separately the fastening of the cover plate 120 pushes the inserted RF filter preform 100 a little bit downward. Due to this the top section of each resonator cavity 10*a*-10*e* is tightly pressed against the top cover 120 of the RF filter. Alternatively, any mechanical contact means can be used.

Figure 7A:
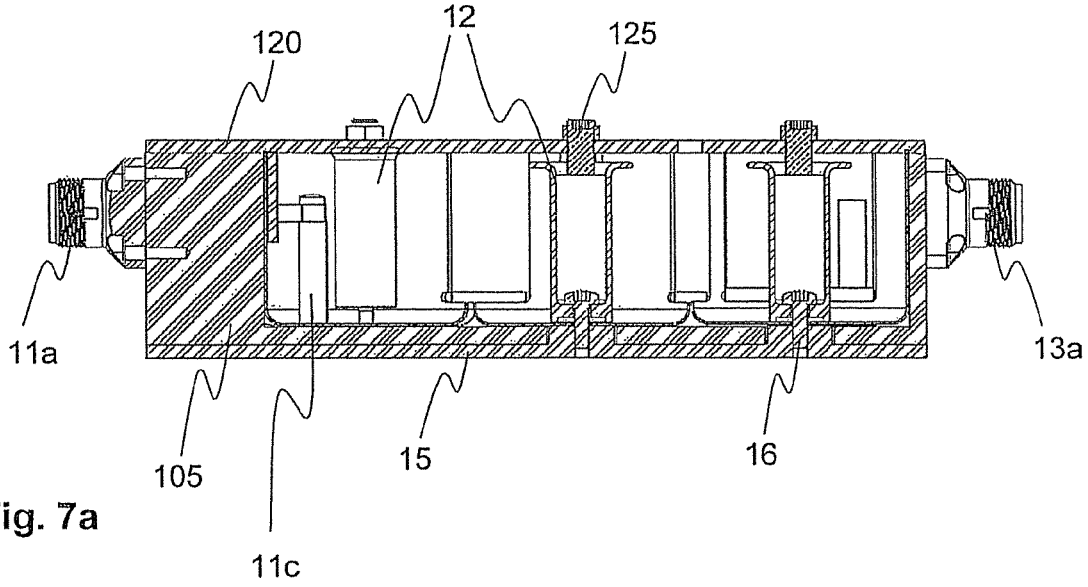
FIG. 7*a* shows a side projection C-C of the RF filter of FIG. 6.

FIG. 7*a* shows a side projection C-C of an embodiment of the RF filter 130 that has a separately manufactured chassis 105. When the base plate 15 has been fastened to the chassis 105, each of the resonators is connected to the metallic base plate 15 through an opening 3 in the cavity by a screw joint 16, for example. By this close fitting heat from the resonator 12 may advantageously be transferred to the base plate. The base plate 15 may be shaped in a way that transfers heat to a defined place in the RF filter arrangement or defined place in the system if the RF filter is a part of a radio module comprising other system components.

The cover plate 120 is connected to the RF filter by some mechanical fastening means (not shown in FIG. 7*a*). The signal is inputted to the RF filter through the input connector 13*a*. The RF signal is coupled via a transformer 11*c* or other suitable apparatus to the output connector 11*a*.

The present invention has the following technical effects that will solve several flaws of RF filter chassis manufacturing known in the art.

Because no plating is required as the cavity surface is formed out of conductive material, manufacturing processes including hazardous materials are not needed.

Secondly, the weight of the RF filter is reduced if plastic material is utilized as a chassis material.

Thirdly, corrosion resistance properties for the main housing can be selected to the purpose. As an example, an outdoor application could use plastic housing which is light weight and corrosion free.

Figure 7B:
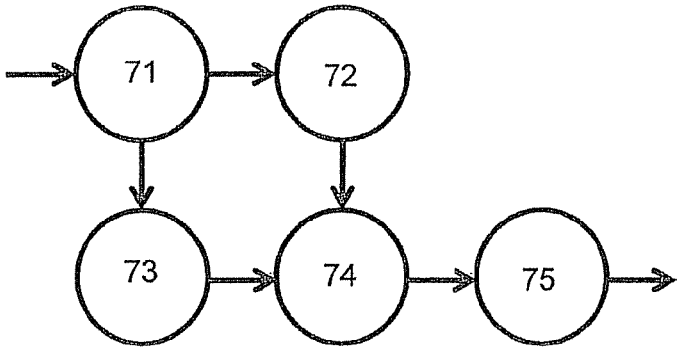
FIG. 7*b* shows an example of a functional layout of another RF filter embodiment.

FIG. 7*b* shows as an example one RF filter having five cavity resonators 71-75 that are manufactured by the inventive manufacturing process. The exemplary RF filter utilises a box section. Box section allows not to have a main line coupling between the sequential resonators and to have a transmission zero located at either side of the pass band. By this kind of a configuration a very steep slope can be achieved in the transition band. In the example of FIG. 7*b* the resonators 72 and 73 are not coupled and the sign of one of the shown couplings from resonator to resonator is opposite to the others within this box section arrangement.

Figure 8:
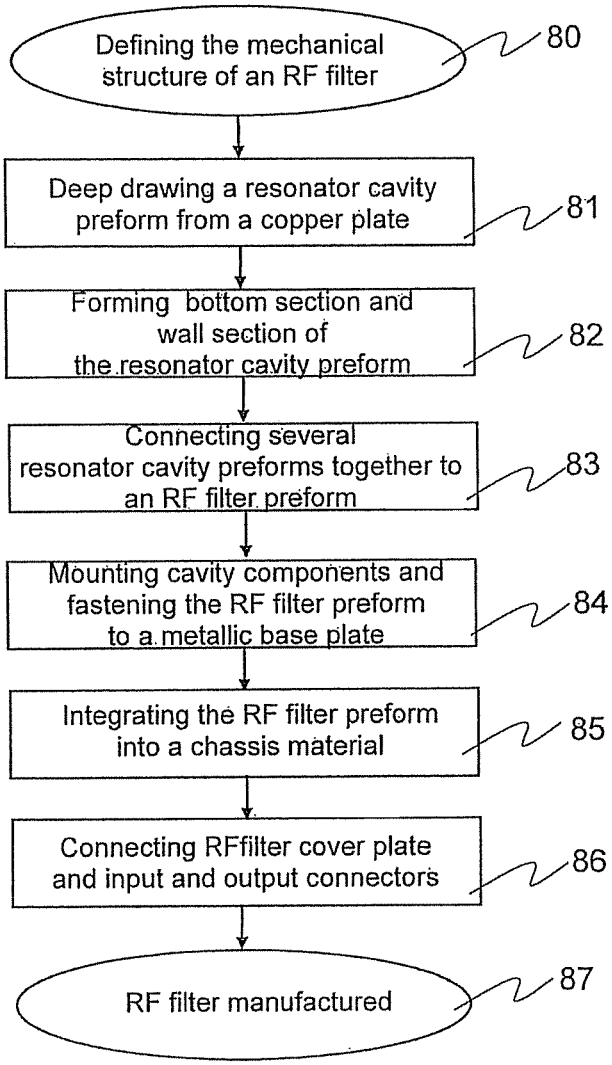
FIG. 8 shows as an exemplary flow chart the main manufacturing steps of an RF filter according to an embodiment of the invention.

The main steps of the manufacturing method according to the first embodiment of the invention are shown as an exemplary flow chart in FIG. 8.

The process starts in step 80 where the electrical parameters of the RF filter to be manufactured are defined. After that the mechanical layout of the RF filter is designed. The mechanical layout may comprise the number of resonator cavities and how they are connected together. Also the chassis material is selected.

In step 81 a required amount of resonator cavity preforms or uniform cavity pluralities 10 are deep drawn or impact extruded from a copper plate by utilizing a proper manufacturing machine.

In step 82 the wall sections 1 of the round resonator cavity preforms 10 are manufactured so that they may be assembled together in the way designed in step 80. Also the openings 3 in the bottom section 2 are advantageously machined in this step.

In an optional step 83 the resonator cavity preforms 10 are fastened together and they constitute an RF filter preform. In one advantageous embodiment several resonator cavity preforms 10 are manufactured in one piece into an RF filter preform.

In step 84 the RF filter preform 100 is fastened to a metallic base plate 15 by some compression contact means. Also resonators 12 and required transformer means are installed in the resonator cavities 10*a*-10*e* of the RF filter preform 100.

In step 85 the chassis 105 of the RF filter preform 100 is manufactured and the RF filter preform is integrated into the chassis. In one embodiment the chassis is injection moulded from a proper plastic material around the RF filter preform 100.

In step 86 the cover plate 120, input connector 13*a* and output connector 11*a* are fastened to the chassis 105 of the RF filter.

The manufacturing process ends in step 87 where the RF filter 130 is assembled.

Figure 9:
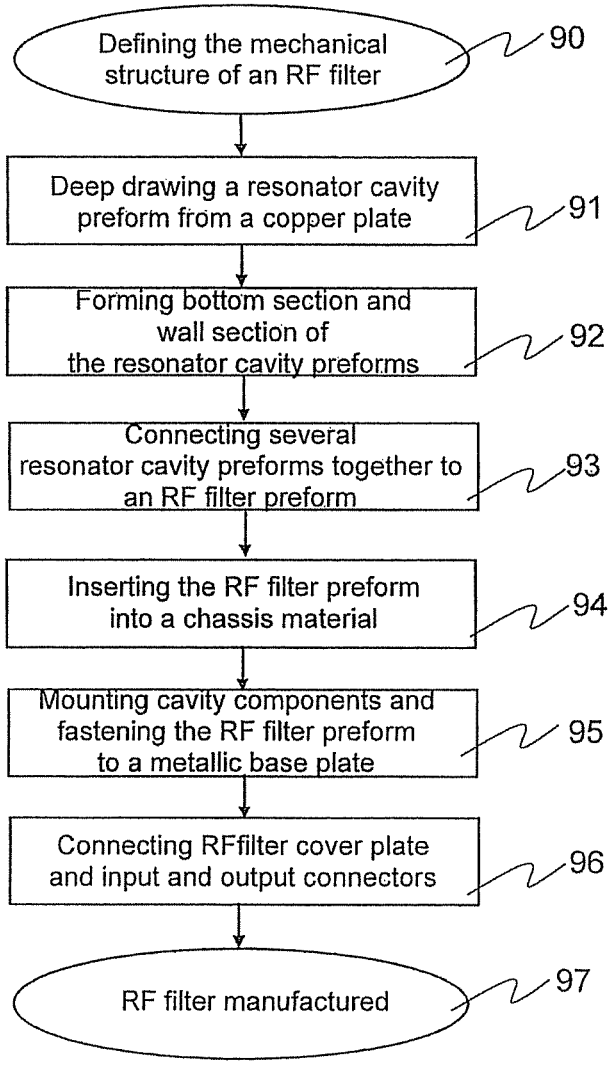
FIG. 9 shows as an exemplary flow chart the main manufacturing steps of an RF filter according to another embodiment of the invention.

The main steps of the manufacturing method according to the second embodiment of the invention are shown as an exemplary flow chart in FIG. 9.

The process starts in step 90 where the electrical parameters of the RF filter to be manufactured are defined. After that the mechanical layout of the RF filter is designed. The mechanical layout may comprise the number of resonator cavities and how they are connected together. Also the chassis material is selected.

In step 91 a required amount of resonator cavity preforms or uniform cavity pluralities 10 are deep drawn or impact extruded from a copper plate by utilizing a proper manufacturing machine.

In step 92 the wall sections 1 of the round resonator cavity preforms 10 are machined so that they may be assembled together in the way designed in step 90. Also the openings 3 in the bottom section 2 are advantageously machined in this step.

In an optional step 93 the resonator cavity preforms 10 are fastened together and they constitute an RF filter preform 100.

In step 94 the resonator cavities 10 or the RF filter preform 100 are inserted into the chassis 105 of the RF filter 130. The chassis 105 has been manufactured separately. The chassis 105 may be injection moulded from a proper plastic, moulded from a proper metal, for example aluminium, or machined from a proper metal slab.

In step 95 the resonator cavities 10, resonators 12 and transformers 11*c* are mounted in the RF filter preform 110. The resonators 12 may be connected to the base plate 15 by a screw 16, for example.

In step 96 the cover plate 120, input connector 13*a* and output connector 11*a* are fastened to the chassis 105 of the RF filter 130.

The manufacturing process end in step 97 where the RF filter 130 is assembled.

The invention being thus described, it will be obvious that the same may be varied in many ways. Although in the examples of the figures a coaxial resonator cavity is depicted, the invention is not limited to the depicted embodiment. Any other suitable shape of the resonator cavity may be utilized in the manufacturing process. Such variations are not to be regarded as a departure from the spirit and scope of the invention, and all such modifications as would be obvious to one skilled in the art are intended to be included within the scope of the following claims.

The invention claimed is:

1. A method for manufacturing an RF filter having cavities, the manufacturing method comprising:

forming the cavities into shape from at least one copper plate in a first manufacturing step; and inserting or integrating the formed cavities into a chassis material in a separate manufacturing step, wherein the RF filter is formed without plating the cavities with an electrically conductive material.

2. The manufacturing method according to claim 1, wherein the first manufacturing step comprises:

forming into shape a resonator cavity preform comprising at least one resonator cavity of said cavities from a copper plate of said at least one copper plate; and machining in the wall and bottom of the formed resonator cavity preform at least one opening.

3. The manufacturing method according to claim 2, wherein:

forming a resonator cavity preform comprises forming a plurality of mechanically separate resonator cavity preforms; and the first manufacturing step further comprises connecting together at least two resonator cavity preforms so as to form an RF filter preform.

4. The manufacturing method according to claim 3, wherein the second manufacturing step comprises:

mounting the RF filter preform mechanically to a base plate, and integrating the RF filter preform into a chassis material, thereby providing a chassis.

5. The manufacturing method according to claim 4, wherein the integrating of the RF filter preform into the chassis material is accomplished by injection moulding the chassis around the RF filter preform.

6. The manufacturing method according to claim 4 or 5, further comprising fastening a cover plate and input connector and output connector to the chassis of the RF filter.

7. The manufacturing method according to claim 1, wherein:

the first manufacturing step comprises forming into shape at least one resonator cavity preform comprising a plurality of resonator cavities from the at least one copper plate; and the method further comprises machining in the wall and bottom of the at least one formed resonator cavity preform at least one opening.

8. The manufacturing method according to claim 7, wherein:

the at least one resonator cavity preform comprises a plurality of resonator cavity preforms;

the method further comprises connecting together at least two of the machined resonator cavity preforms so as to form an RF filter preform.

9. The manufacturing method according to claim 7, wherein the second manufacturing step comprises:

inserting the at least one resonator cavity into a separately manufactured chassis of the RF filter;

mounting cavity components; and mechanically connecting the at least one resonator cavity to a base plate.

10. The manufacturing method according to claim 9, wherein the chassis is manufactured by injection moulding it from a proper plastic, moulding it from aluminium or machining it from a proper aluminium slab.

11. The manufacturing method according to claim 9, wherein the cover plate and input connector and output connector are fastened to the chassis of the RF filter.

12. The method of claim 1, wherein each of the cavities is cylindrical.

13. An RF filter comprising:

at least one resonator cavity;

a chassis of the RF filter;

a metallic bottom plate, separate from the at least one resonator cavity;

a cover plate; and an input connector and an output connector, wherein the resonator cavities are formed into shape from a copper plate and are configured to be inserted or integrated into the chassis of the RF filter, and wherein the resonator cavities are not plated with an electrically conductive material.

14. The RF filter according to claim 13, wherein the resonator cavities are formed into shape to a resonator cavity preform comprising at least one resonator cavity from a copper plate by deep drawing or impact extrusion.

15. The RF filter according to claim 13, wherein the chassis of the RF filter is manufactured into shape by injection moulding it from plastic or moulding or machining it from aluminium.

16. The RF filter according to claim 13, wherein the resonator cavities are fastened to the base plate by a screw that fastens a resonator to the chassis and to the base plate via an opening in a bottom section of each resonator cavity.

17. The RF filter of claim 13, wherein each of the at least one resonator cavities is cylindrical.

* * * * *